US008580089B2

(12) United States Patent
Lagos Lehuede et al.

(10) Patent No.: US 8,580,089 B2
(45) Date of Patent: Nov. 12, 2013

(54) SYSTEM FOR THE SUPERPOSITION OF ALTERNATING CURRENT IN ELECTROLYSIS PROCESSES

(75) Inventors: Patricio Clemente Lagos Lehuede, Santiago (CL); Ricardo Armando Feuntes Fuentealba, Santiago (CL); Jorge Luis Estrada Gonzalez, Santiago (CL)

(73) Assignee: Ingenieria Y Desarrollo Technologico S.A., Estacion Central (CL)

( * ) Notice: Subject to any disclaimer, the term of this patent is extended or adjusted under 35 U.S.C. 154(b) by 194 days.

(21) Appl. No.: 13/265,668

(22) PCT Filed: Apr. 23, 2010

(86) PCT No.: PCT/CL2010/000016

§ 371 (c)(1),
(2), (4) Date: Nov. 23, 2011

(87) PCT Pub. No.: WO2010/121389

PCT Pub. Date: Oct. 28, 2010

(65) Prior Publication Data

US 2012/0067719 A1 Mar. 22, 2012

(30) Foreign Application Priority Data

Apr. 23, 2009 (CL) ..... 969-2009

(51) Int. Cl.

| | |
|---|---|
| ***C25C 1/12*** | (2006.01) |
| ***C25C 7/06*** | (2006.01) |
| ***C25C 1/00*** | (2006.01) |

(52) U.S. Cl.

USPC ..... 204/229.7; 204/229.5; 205/341; 205/560; 205/574

(58) Field of Classification Search

USPC ..... 204/229.7, 230.8

See application file for complete search history.

(56) References Cited

U.S. PATENT DOCUMENTS

| | | | | |
|---|---|---|---|---|
| 1,527,734 | A * | 2/1925 | Huggins | 205/104 |
| 4,024,035 | A * | 5/1977 | Enchev et al. | 205/342 |
| 4,430,178 | A | 2/1984 | Anderson et al. | |
| 5,421,985 | A | 6/1995 | Clouser et al. | |

(Continued)

FOREIGN PATENT DOCUMENTS

AU 15975 70 A 12/1971

*Primary Examiner* — Harry D Wilkins, III

(74) *Attorney, Agent, or Firm* — Fish & Richardson P.C.

(57) ABSTRACT

A system is submitted here that permits superimposing an alternating current in the process of electrolytic refining of metals based on the use of power semiconductors without requiring an external source and which minimizes the utilization of passive elements, achieving a high efficiency solution applicable to high power industrial processes. The invention consists of the division of the cells involved in the metals electrolysis process in two groups of cells (3*a*) and 3*b*, both comprising a similar number of anode-cathode pairings, and with both groups linked by a common point for electrical connection (6), and interconnected by means of a bidirectional power converter (7). Said power converter (7) is connected to the common point for electrical connection 6 of the groups of cells (3*a*, 3*b*) and to the other two connection points of each group of cells, so that its operation permits transferring power from one group to the other. This, the adequate operation of the bidirectional power converter permits superimposing an alternating current of variable frequency and breadth between the groups of cells, of an average value of zero, taking advantage of the storage (charge) and power supply (discharge) characteristics of the cells utilized in the electrolytic processing of metals.

6 Claims, 3 Drawing Sheets

(56) References Cited

U.S. PATENT DOCUMENTS 5,872,443 A * 2/1999 Williamson ..... 320/160
2007/0125659 A1* 6/2007 Hecker Cartes ..... 205/341
2011/0073487 A1* 3/2011 Niu et al. ..... 205/687

* cited by examiner

SYSTEM FOR THE SUPERPOSITION OF ALTERNATING CURRENT IN ELECTROLYSIS PROCESSES

CROSS REFERENCE TO PRIOR APPLICATIONS

This is a U.S. National Phase application under 35 U.S.C. §371 of International Patent Application No. PCT/c12010/000016, filed Apr. 23, 2010, and claims the priority of Chilean Patent Application No. 969-2009, filed Apr. 23, 2009 both of which are incorporated by reference herein. The International Application published in Spanish on Oct. 28, 2010 as WO 2010/121389 under PCT Article 21(2).

FIELD OF APPLICATION

In processes of electrolytic refining and electrodeposition of metals, the treatment involves a flow of direct current from an external source that circulates through an arrangement of one or more serially connected electrolytic cells, where such electrolytic cells consist of an arrangement of one or more anode-cathode pairings connected in parallel and submerged in a electrically conductive medium known as electrolyte. The metal to be refined is deposited in the cathode in the form of metallic particles coming from the anode (electrorefining) or contents in the electrorefining solution (electrodeposition). A soluble anode is used in the process of electrorefining and an insoluble anode is used in the process of electrorefining and an insoluble anode is used in the electrodeposition of metals.

In the elctrolytic treatment of copper the impure copper anode is dissolved by means of an electric current, the copper thus dissolved is reduced on the cathode, forming pure copper plating. In the electrodeposition process the ionized metal in the electrolyte, known as enriched electrolyte, is reduced in a process where the anode is an insoluble metal conductor that acts only as an electric pole. A solution of water and sulphuric acid is normally used as electrolyte. One or more power rectifiers are used as a source of power to generate the non-pulsating electric current necessary for the electrolysis process.

The electric current required by the electrolysis process generally comes from one or several transformer-controlled rectifier systems that allow for the transfer of power from a source of alternating current towards a charge of direct current. The transformer permits the reduction of the voltage level of the plant feeding network to a voltage that depends on the number of cells forming part of the facility. The controlled rectifier make it possible to convert the alternating voltage reduced by the transformer into direct voltage that will eventually feed direct current into the groups of electrolytic cells comprising the plant.

The production capacity of an electrolysis plant depends, among other factors, on the number of cathodes and the current applied in the process. From the above it is understood that in order to increase the production capacity of a plant it would be necessary to increase the number of cathodes, or increase the current applied in the process or a combination of both options. If an increase in the number of cathodes is desired, it will be necessary to increase the number of cells, with the resulting increase in direct voltage, or else increase the number of cathodes per cell. Both are structural solutions that require major modifications, either by increasing the number of cells or their size. This does not occur in attempts to increase production through an increase in the current density, that is, an increase in the flow of direct current per surface unit of the cathode (anode) maintaining the same number of cells and the number of anode-cathode pairings within it. However, this solution requires an increase in the direct current. An alternative to this is to incorporate a new transformer-controlled rectifier system connected in parallel with the existing system.

There is a limit to the continued increase of current density, reaching maximum values as a result of the diminution of the physical-chemical quality of the cathodes. Given the above, methods need to be implemented that permit an increase in the density of the current, maintaining or improving the quality of the cathodes obtained in the metal electrolysis processes.

STATE OF THE ART

The following are some of the most important technological developments aimed at the improvement of electrolytic copper production:

- The development of the cathodes, from copper sheet to stainless steel sheet (permanent cathode), has made it possible to increase up to 350 A/m$^2$ the density of current utilized in the process to obtain copper via electrolytic processing, thus increasing production indexes.
- New inter-cell bar designs have made it possible to diminish the drop in voltage of the same.
- Use of non soluble anode plates.
- Development of new electrolytic cells The alternative of increasing the average current density in copper electrolysis to very high values, utilizes ultrasonic vibration and agitation via the injection of pressurized air to improve the quality of copper deposition on the cathodes.

Also, a technique of periodical reversal of the current's polarity to improve cathode quality has been studied in the following sources:

- Vene, Y. Y., and Nikolaeva S. A., "Investigation of the Effect of Periodic Changes in Current Non pulsating ion in the Electrodeposition of Copper From Sulfate Baths", Zhurnal Fizicheskoi Khimii, V. 29, No. 5, pp. 811-817.
- Volkov, L. V. and Andrushenko, "Use of Alternating Current for Improvement of Nickel Electroplating", Tr. Proektn. Nauchnolssied inst. Giprobikel, V. 62, 1975, pp. 99-104.

However, research indicates that superimposing direct current in the process of electrolysis offers better results than a periodical reversal of current direction in terms of an improvement in the process of production of metals, as is discussed in the following sources:

- Grube, G., and Gmelin H, "The Influence of Superimposed Alternating Current on Anodic Ferrate Formation", Z. Elektrochem., V. 26, 1920, pp. 153-161.
- Skirstymonskaya, V. I., "Effect of Superimposed Alternating Current on the Electrodeposition of Zinc and Copper", J. Applied Chem., V. 10, 1937, pp. 617-622.
- Izgaruishev, N. A., and Kudryavtzev N. T., "The Influence of Alternating Current on Current Efficiency in Electrolytic Precipitation of Metals", Z. Elektrochem., V. 38, 1932, pp. 131-135.

The application described in U.S. Pat. No. 2,515,192 uses superimposed alternating current to achieve a uniform distribution in the process of galvanoplastics and the application described in U.S. Pat. No. 2,706,170 seeks to diminish internal pressures in the same process by superimposing alternating current.

Among methods to superimpose alternating current in electrolysis processes, the application described in U.S. Pat. No. 2,433,599 applied to low voltage galvanoplastic processes utilizes an external source that incorporates a transformer connected to the feeding network and passive elements such as resistors and variable electrical inductances. U.S. Pat. No. 4,170,739 proposes a modification of the transformer coils to supply alternating electrical current to the load. In both cases, the applicability of the methods in high voltage processes is limited by the size of the elements required and the high investment this involves.

A method that does not utilize an external source is discussed in U.S. Pat. Application 2008/0285320 A1(currently in the process of approval). In this case, a half-bridge power converter is connected in parallel to a bank of condensers that permits drawing, accumulating and re-injecting current onto the electrowinning cells, which are fed from a transformer-controlled rectifier assembly. It has the advantage that it does not utilize an external source and utilizes instead two passive elements to realize the transference of energy during the processes of extraction (inductancy) and accumulation (condenser).

DESCRIPTION OF THE INVENTION

In the framework of the superimposing of alternating current in the process of electrolysis of metals, this invention propses a method that uses a bidirectional power converter and the charge/discharge capacity of the electrolysis cells to obtain a more efficient process than the method proposed to date.

Figure 1:
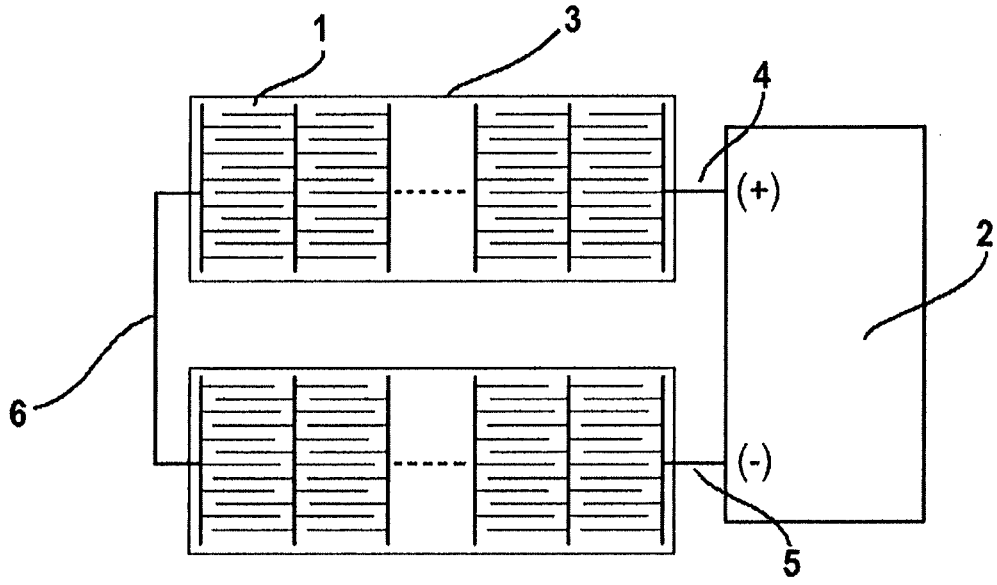
FIG. 1 is a general layout plan of a plant for electrolytic metal processing.

In industrial processes for the electrolytic production of metal, anode-cathode pairings are grouped in various electrolytic cells (1) connected electrically in series and fed from a transformer-controlled rectifier system (2). As shown in FIG. 1, the plants usually consider two groups of an equal number of cells (3), such that the positive pole (4) and the negative pole (5) of the transformer-controlled rectifier system (2) are connected at the same end of the plant.

The invention consists of dividing the cells involved in the process of electrolytic production of metals in two groups of cells (3*a*, 3*b*) both formed by a similar number of anode-cathode pairings, both groups joined by a common point for electrical connection (6), and interconnected by means of a bidirectional power converter (7). Said power converter (7) is connected to the common point for electrical connection (6) of the groups of cells (3*a*, 3*b*) and to the other two connection points in each group of cells, so that their operation allows them to transfer power from one group to the other. This way, the adequate operation of the bidirectional power converter allows for the superimposing of an alternating current with a variable frequency and breadth between the groups of cells, with an average value of zero, taking advantage of the storage (charge) and energy supply (discharge) characteristics of the cells utilized in the process of electrolytic production of metals.

Figure 2:
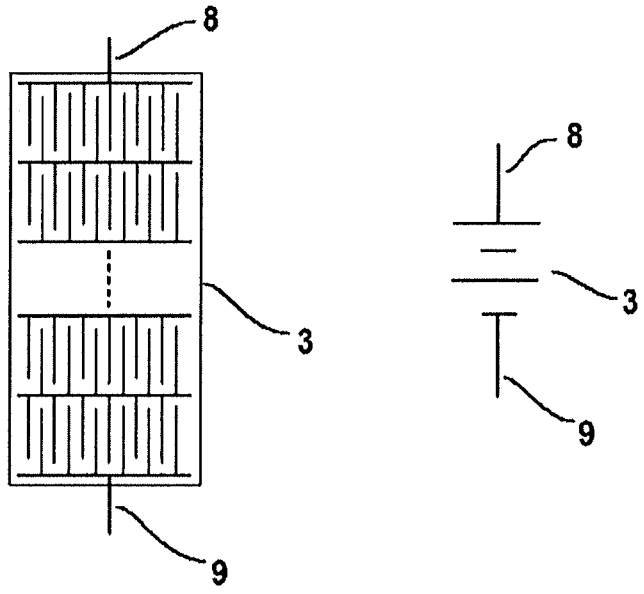
FIG. 2 is the diagram of a model of concentrated parameters for a group of cells.

FIG. 2 shows the representation through a battery of groups of cells (3) and the anode bar (8) and the cathode bar (9).

Figure 3:
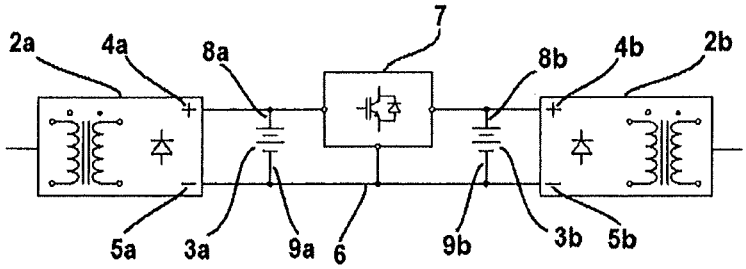
FIG. 3 is a diagram of the connection between the bidirectional power converter and the groups of cells when each group is fed from an independent transformer-controlled rectifier system and the common connection point is the negative pole of each transformer-controlled rectifier system.
Figure 4:
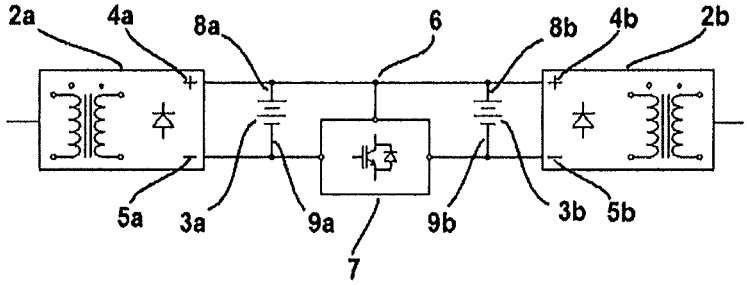
FIG. 4 is a diagram of the connection between the bidirectional power converter and the banks of cells, where each group is fed from an independent transformer-controlled rectifier system and the common connection point is the positive pole of each transformer-controlled rectifier system.

One way of connecting the cell groups and the bidirectional power converter is that each group of cells (3*a*, 3*b*) is fed from an independent transformer-controlled rectifier system (2*a*, 2*b*) such that the common electrical connection point (6) is one of the equipotential points of the transformer-controlled rectifier system (2*a*, 2*b*). FIG. 3 shows the case in which such common point is the negative pole (5*a*, 5*b*), the other two connection points of the bidirectional power converter are connected to the anode bars (8*a*, 8*b*) of each group of cells (3*a*, 3*b*) and each individual positive pole (4*a*, 4*b*). FIG. 4 shows the case in which that common point is the positive pole (4*a*, 4*b*) of the rectifiers (2*a*, 2*b*), the other tow points of connection of the bidirectional power converter are connected to the cathode bars (9*a*, 9*b*) of each group of cells (3*a*, 3*b*) and to each individual negative pole, (5*a*, 5*b*).

Figure 5:
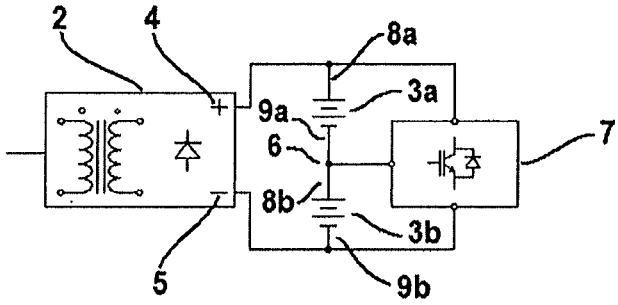
FIG. 5 is a diagram of the connection between the bidirectional power converter and the cell banks in which a single transformer-controlled rectifier feeds the serially connected cell banks.

FIG. 5 illustrates the case in which a transformer-controlled rectifier system (2) feeds the two serially connected groups of cells (3*a*, 3*b*) where the common point for electrical connection is an anode bar (8*b*) of a group of cells (3*b*) and a cathode bar (9*a*) from another group of cells (3*a*) and the other two connection points of the bidirectional converter (7) are connected to the cathode bar (9*b*) and the anode bar (8*a*) of each group of cells (3*a*, 3*b*) as applicable.

We would like to point out that upon selecting groups of cells (3*a*, 3*b*) with different numbers of anode-cathode pairings, the operation of the bidirectional power converter (7) would permit the generating of an unbalance of currents between the groups of cells that can be beneficial in the electrolytic processing of some metals.

The invention is a method that makes it possible to superimpose an alternating current over the direct current that feeds the cells formed by anode-cathode pairings in the electrolytic processing of metals. This invention utilizes the cells' charge and discharge capacities to generate the alternating current. Thus, the negative half-wave of alternating current in a group of cells (3*a*) is equivalent to a current discharged by the same. At the same time, this current is injected into another group of cells (3*b*) becoming a positive cycle for the latter. The phenomenon is repeated inversely and periodically. The alternating current circulates between cells with maximum efficiency without storing energy in external elements. The above is achieved by dividing the cells into two groups of cells (3*a*, 3*b*) and incorporating a bidirectional power converter (7) whose operation will make it possible to transfer power between the groups. The above is applicable to any electrolytic metal processing, particularly in the processes of electrodepositing and electrorefining of copper.

Figure 6:
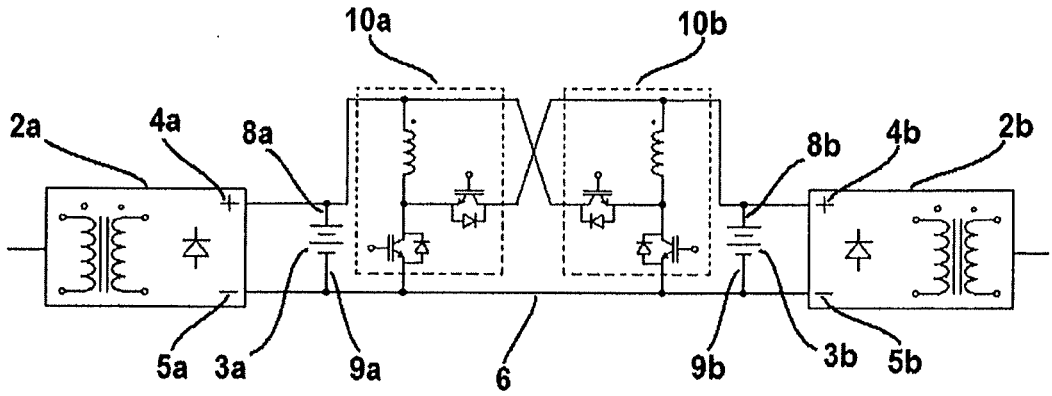
FIG. 6 is a diagram similar to FIG. 3, describing the use of two power converters such as submitted in U.S. Pat. No. 4,801,859 as a bidirectional power converter.
Figure 7:
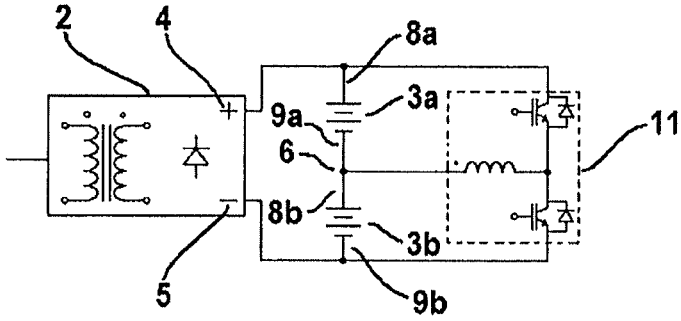
FIG. 7 is a diagram similar to FIG. 5, describing the use of a single converter such that submitted in U.S. Pat. No. 4,736,151 as a bidirectional converter.

The type of bidirectional power converter (7) to be used depends on how the groups of cells (3*a*, 3*b*) are connected. For example, if a connection such as the one illustrated in FIG. 3 is required, it is possible to use two power converters (10*a*, 10*b*) as the power converter as set forth in U.S. Pat. No. 4,801,859 shown in FIG. 6. If a connection such as that illustrated in FIG. 5 is required, it is possible to use the power converter submitted in U.S. Pat. No. 4,736,151 (11) as shown in FIG. 7.

The invention claimed is:

1. A system for superimposing an alternating current onto the direct current that feeds the electrolytic cells in a process of metals electrolysis comprising:

a. two groups of cells, each group formed by at least one bar of anodes, one bar of cathodes and one of several anode-cathode bars wherein the connection between the anode bar or the cathode bar of the first group defines a common connection point between the groups of cells;

b. two sources of direct current that supply direct current to said groups of cells, each source with a negative pole connected to the cathode bar of the respective group, and a positive pole, connected to the anode bar of the respective group; and, c. a bidirectional power converter that permits power to be transferred between both groups of cells, with three points for electrical connection, such that the first point of the converter being connected to said common connection point between the groups of cells, the second point of connection of the converter being connected to the available bar between the cathode bar and the anode bar of the first group of cells, and the third point for connection of such converter being connected to the available bar between the cathode bar and the anode bar of the second group of cells, in a manner such that the cyclic and alternating operation of each power transference cycle between the groups of cells generates an alternating current superimposed onto the direct current supplied by the sources of direct current.

2. A system for superimposeing an alternating current according to claim 1, wherein the sources of direct current consist of one or several transformer-controlled rectifier systems.

3. A system for superimposing an alternating current according to claim 1, wherein the bidirectional power converter consists of one or several electronic power devices formed by semiconductors, condensers and inductances.

4. A system for superimposing a flow of alternating current onto the direct current that feeds the electrolytic cells in a process of metals electrolysis comprising:

a. two groups of cells, each group formed by at least one bar of anodes, one bar of cathodes and one of several anode-cathode bars wherein the connection between the anode bar of the first group and the cathode bar of the second group defines a common connection point between the groups of cells;

b. one source of direct current that supplies direct current to said groups of cells, the source having a negative pole connected to the cathode bar of the first group, and a positive pole connected to the anode bar of the second group; and, c. a bidirectional power converter that permits power to be transferred between both groups of cells, with three points for electrical connection, such that the first point of the converter being connected to said common connection point between the groups of cells, the second point of connection of the converter being connected to the cathode bar of the first group of cells, and the third point of the converter being connected to the anode bar of the second group of cells, in a manner such that the cyclic and alternating operation of each power transference cycle between the groups of cells generates an alternating current superimposed onto the direct current supplied by the source of direct current.

5. A system for superimposeing an alternating current according to claim 4, wherein the source of direct current consists of one or several transformer-controlled rectifier systems.

6. A system for superimposing an alternating current according to claim 4, wherein the bidirectional power converter consists of one or more electronic power devices formed by semiconductors, condensers and inductances.

* * * * *